US006013430A

United States Patent [19]

Chen et al.

[11] Patent Number: 6,013,430

[45] Date of Patent: Jan. 11, 2000

[54] THERMAL RECORDING ELEMENT

[75] Inventors: Huijuan D. Chen, Webster; Derek D. Chapman, Rochester, both of N.Y.

[73] Assignee: Eastman Kodak Company, Rochester, N.Y.

[21] Appl. No.: 09/037,207

[22] Filed: Mar. 10, 1998

[51] Int. Cl.[7] ..... G03C 1/14

[52] U.S. Cl. ..... 430/584; 430/390; 430/339; 430/944

[58] Field of Search ..... 430/584, 201, 430/338, 339, 944, 351; 503/227

[56] References Cited

U.S. PATENT DOCUMENTS

| | | | |
|---|---|---|---|
| 4,767,696 | 8/1988 | Ishimoto et al. | 430/495 |
| 5,154,995 | 10/1992 | Kawai | 430/944 |
| 5,409,797 | 4/1995 | Hosoi et al. | 430/944 |
| 5,427,901 | 6/1995 | Arakatsu et al. | 430/944 |
| 5,561,039 | 10/1996 | Ochiai | 430/584 |

*Primary Examiner*—Janet Baxter
*Assistant Examiner*—Amanda C. Walke
*Attorney, Agent, or Firm*—Harold E. Cole

[57] ABSTRACT

A thermal recording element comprising a support having thereon a recording layer comprising a J-aggregate cyanine dye dispersed in a hydrophilic binder, the J-aggregate dye having the formula:

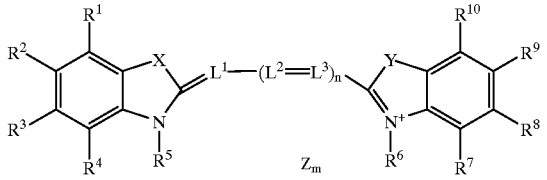

wherein

X and Y each independently represents O, S, a NR group or CH=CH;

R represents a substituted or unsubstituted alkyl group having from about 1 to about 6 carbon atoms;

$R^1$, $R^2$, $R^3$, $R^4$, $R^7$, $R^8$, $R^9$ and $R^{10}$ each independently represents a substituted or unsubstituted alkyl or alkoxy group having from about 1 to about 6 carbon atoms; halogen; a substituted or unsubstituted aryl group having from about 6 to about 10 atoms; or a substituted or unsubstituted heteroaryl group having from about 5 to about 10 atoms;

any two adjacent substituents on the aryl ring may be taken together to form a 6-membered aromatic ring;

$R^5$ and $R^6$ each independently represents a substituted or unsubstituted alkyl group having from about 1 to about 6 carbon atoms or sulfoalkyl;

$L^1$, $L^2$ and $L^3$ each independently represents a substituted or unsubstituted methine group;

Z represents an inorganic or organic cation;

n is 0–3, and m is 0 or 1.

8 Claims, No Drawings

THERMAL RECORDING ELEMENT

FIELD OF THE INVENTION

This invention relates to thermal recording elements, and more particularly to such elements which contain a J-aggregate cyanine dye for generating visual continuous tone images in a single-sheet process.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Still another way to generate an image in a thermal recording process is to use a direct thermal recording element which contains a material which, when heated with a thermal head or an infrared laser, forms a visible image. In this process, there is no transfer of dye to a separate receiving element.

DESCRIPTION OF RELATED ART

U.S. Pat. No. 4,767,696 relates to a laser information recording system comprising a substrate, a reflective layer, and a recording layer. The recording layer comprises cumulative sublayers of J-aggregate dyes formed from mixtures of a cyanine dye and at least two specific cationic film-forming materials using the Langmuir-Blodgett thin film technique.

When organic dye molecules, e.g., cyanine dye molecules, are highly concentrated in an aqueous solution, there appears an absorption band or peak which has a large absorption intensity at a longer wavelength than is the case of a single molecule absorption band and has a very narrow half-amplitude level. There is also an absorption band of a single molecule of the dye, an absorption band of the dimer form at a shorter wavelength, and an absorption band of polymolecular aggregates. This absorption band is called the J-absorption band and is known to derive from aggregates of dye molecules called J-aggregates. J-aggregates are characterized by a narrow intense absorption peak that is bathochromically shifted relative to the monomer absorption.

However, there is a problem with using these J-aggregates in a thermal recording layer in that the efficiency of deaggregation is low, causing very poor contrast, as will be shown hereinafter.

It is an object of this invention to provide a thermal recording element using a J-aggregate which has a high deaggregation efficiency. It is another object of the invention to provide a thermal recording element using a J-aggregate which has high image contrast to give a visual continuous tone upon imagewise heating.

SUMMARY OF THE INVENTION

These and other objects are achieved in accordance with this invention which relates to a thermal recording element comprising a support having thereon a recording layer comprising a J-aggregate cyanine dye dispersed in a hydrophilic binder, the J-aggregate dye having the formula:

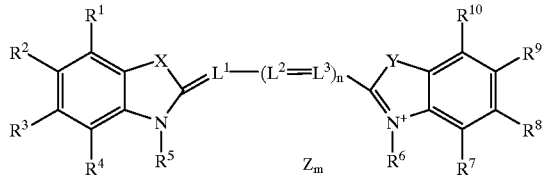

wherein:

X and Y each independently represents O,S, a NR group or CH=CH;

R represents a substituted or unsubstituted alkyl group having from about 1 to about 6 carbon atoms, such as methyl, ethyl, propyl, methoxyethyl, etc., $R^1$, $R^2$, $R^3$, $R^4$, $R^7$, $R^8$, $R^9$ and $R^{10}$ each independently represents a substituted or unsubstituted alkyl or alkoxy group having from about 1 to about 6 carbon atoms, such as methyl, ethyl, propyl, methoxyethyl, methoxy, ethoxy, etc.; halogen, such as chloro, bromo, iodo, etc.; a substituted or unsubstituted aryl group having from about 6 to about 10 atoms, such as phenyl, tolyl, etc.; or a substituted or unsubstituted heteroaryl group having from about 5 to about 10 atoms, such as pyrrolo;

any two adjacent substituents on the aryl rings may be taken together to form a 6-membered aromatic ring;

$R^5$ and $R^6$ each independently represents a substituted or unsubstituted alkyl group having from about 1 to about 6 carbon atoms such as those listed above for R; or sulfoalkyl such as sulfopropyl, 2-hydroxy-3-sulfopropyl, etc.;

$L^1$, $L^2$ and $L^3$ each independently represents a substituted or unsubstituted methine group;

Z represents an inorganic or organic cation, such as triethylammonium, potassium, sodium;

n is 0–3, and m is 0 or 1.

DESCRIPTION OF THE PREFERRED EMBODIMENTS

The present invention uses a single-layer coating containing a J-aggregate cyanine dye in a hydrophilic polymer binder, such as gelatin, and generates visual images by imagewise heating of this single layer. The cyanine dyes readily form J-aggregates in a gelatin coating without additional film-forming materials when such a coating dries on a substrate. The element is easy to coat and its structure is simple, having only the recording layer on a support.

Examples of J-aggregate cyanine dyes employed in the invention are as follows:

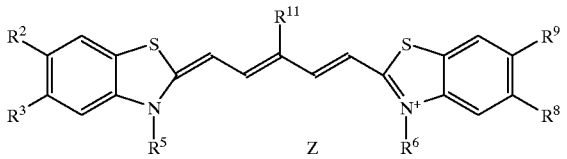

| Dye | $R^2$ | $R^3$ | $R^5$ | $R^6$ | $R^8$ | $R^9$ | $R^{11*}$ | Z** |
|---|---|---|---|---|---|---|---|---|
| 1 | H | Cl | $(CH_2)_3SO_3^-$ | $(CH_2)_3SO_3^-$ | Cl | H | $CH_3CH_2$ | $(C_2H_5)$—NH[CH—$(CH_3)_2]_2^+$ |
| 2 | H | 1-pyrrolo | $(CH_2)_3SO_3^-$ | $(CH_2)_3SO_3^-$ | 1-pyrrolo | H | $CH_3CH_2$ | $(C_2H_5)_3NH^+$ |
| 3 | H | $CH_3O$ | $(CH_2)_3SO_3^-$ | $(CH_2)_3SO_3^-$ | $CH_3O$ | H | $CH_3CH_2$ | $(C_2H_5)_3NH^+$ |
| 4 | Cl | Cl | $(CH_2)_3SO_3^-$ | $(CH_2)_3SO_3^-$ | Cl | Cl | $CH_3CH_2$ | $(C_2H_5)_3NH^+$ |
| 5 | H | H | $CH_2CHOH$—$CH_2SO_3^-$ | $CH_2CHOH$—$CH_2SO_3^-$ | H | H | $CH_3CH_2$ | $K^+$ |
| 6 | H | Cl | $C_2H_5$ | $(CH_2)_3SO_3^-$ | Cl | H | $CH_3CH_2$ | — |
| 7 | H | Cl | $C_3H_7$ | $(CH_2)_3SO_3^-$ | Cl | H | $CH_3CH_2$ | — |
| 8 | H | H | $CH_3$ | $CH_2CHOH$—$CH_2SO_3^-$ | H | H | $CH_3CH_2$ | — |

*$R^{11}$ can be an alkyl group of from 2 to about 6 carbon atoms;

**Z may be either a cation or absent depending on the number of charged groups in $R^5$ and $R^6$

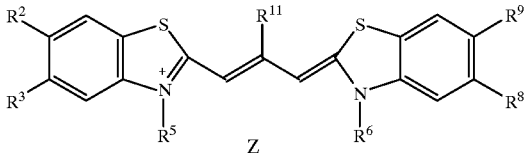

| Dye | $R^5 = R^6$ | $R^3$ | $R^2$ | $R^8$ | $R^9$ | $R^{11}$ | Z |
|---|---|---|---|---|---|---|---|
| 9 | $(CH_2)_3SO_3^-$ | Cl | H | Cl | H | $CH_3CH_2$ | $(C_2H_5)_3NH^+$ |
| 10 | $(CH_2)_3SO_3^-$ | —$OCH_2O$— | | —$OCH_2O$— | | $CH_3CH_2$ | $(C_2H_5)_3NH^+$ |

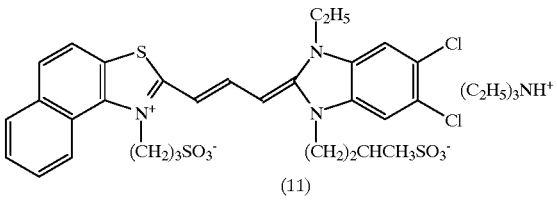

(11)

-continued

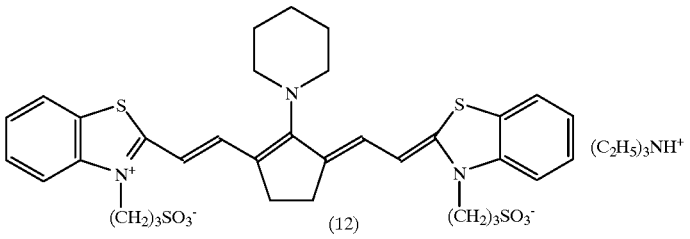

(12)

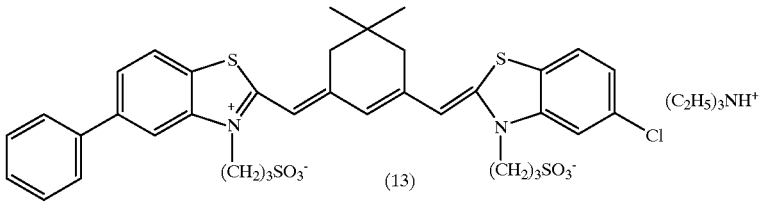

(13)

The J-aggregate dyes employed in the invention have sharp absorption peaks that are bathochromically shifted relative to their nonaggregated states when these dyes are coated in a hydrophilic binder such as gelatin. When heated with a thermal head, flash or an infrared laser, a visible image with high contrast ($D_{max}/D_{min}$ up to 11) can be generated due to deaggregation of the dye aggregate.

Another embodiment of the invention relates to a process of forming a single color image comprising imagewise-exposing by means of a flash, thermal print head or laser, in the absence of a separate receiving element, the thermal recording element as described above, thereby imagewise-heating the recording layer and causing it to change color, thereby creating the single color image.

To prepare the recording layer coating of the invention, the chosen cyanine dye is dissolved in an aqueous medium comprising water and a hydrophilic binder, such as gelatin (preferably deionized gelatin). The coating melt can then be subjected to heat treatment at elevated temperatures, such as 40° C.–100° C., for a period of time, such as 5 min to 24 hrs. Adjustments of the pH and ionic strength of the melt may be necessary to control dye solubility in the aqueous medium. Typically, the dye concentration in the melt is 0.05%–1%, by weight, at a laydown of 0.02–0.16 g/m$^2$; and the gelatin concentration in the melt is 0.88%–6.6%, by weight, with a laydown of 0.22–1.62 g/m$^2$.

Different methods of heating can be used to image the thermal recording elements of the invention. For example, a flash can be used such as a xenon flash lamp with a maximum energy of 9 J/cm$^2$. A thermal print head can also be used such as one with a heating voltage of 12–14 v and a heating speed of 4 ms/line for a 640 line image. Further, an infrared laser writer can be used such as Laser Model SDL-2420-H2 from Spectra Diode Labs, or Laser Model SLD 304 VW from Sony Corp.

The recording elements of this invention can be used to obtain medical images, reprographic masks, printing masks, etc. The image obtained can be a positive or a negative image. The process of the invention can generate either continuous (photographic-like) or halftone images.

Any hydrophilic material may be used as the binder in the recording element employed in the invention. For example, there may be used gelatin, a poly(ethylene oxide), a poly (vinyl alcohol), a polyacrylic acid, a poly(vinyl pyrrolidone), poly(vinylpyridine), poly(hydroxyethyl acrylate) or mixtures or copolymers thereof. The binder may be used at a coverage of from about 0.1 to about 5 g/m$^2$.

When the absorption in the IR region of the J-aggregate dye is not sufficient for IR laser imaging, then an additional water-soluble IR absorber may be used. Such water-soluble infrared-absorbing materials include cyanine infrared-absorbing dyes as described in U.S. Pat. No. 5,695,918, the disclosure of which is hereby incorporated by reference. The infrared-absorbing material may be either in the recording layer or a layer underneath or on top thereof.

Any material can be used as the support for the recording element of the invention provided it is dimensionally stable and can withstand the heat of the flash, thermal head or laser. Such materials include polyesters such as poly(ethylene naphthalate); polysulfones; poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 $\mu$m. It can be transparent or opaque such as paper.

The following examples are provided to illustrate the invention.

EXAMPLES

Example 1

Flash Exposure

A) Cyanine dye 1 in the amount of 33 mg. was added to a solution of deionized gelatin (333 mg. dry in 12.5 g water) so that the final concentration of cyanine dye and gelatin in the melt was 0.22 wt-% and 2.2 wt-%, respectively. The solution was heated to 50° C. for 30 min. and then coated onto a poly(ethylene terephthalate) support with a final laydown of 0.05 g/m$^2$ of dye and 0.54 g/m$^2$ of gelatin. The coating was chill-set and allowed to air-dry overnight before the imaging experiment was run.

B) An element similar to A) was prepared except that Dye 2 was employed instead of Dye 1.

C) An element similar to A) was prepared except that Dye 9 was employed instead of Dye 1.

D) An element similar to A) was prepared except that Dye 12 was employed instead of Dye 1.

E) An element similar to A) was prepared except that Dye 13 was employed instead of Dye 1.

F) An element similar to A) was prepared except that Dye 11 was employed instead of Dye 1

Control) A control element similar to A) was prepared except that C-1, a cyanine dye from U.S. Pat. No. 4,769,696, was employed instead of Dye 1:

C-1

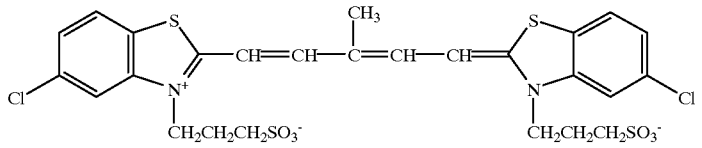

$(CH_3CH_2)_3NH^+$ (U.S. Pat. No. 4,767,696)

The λ-max of the dyes used in the above elements was measured using a Hewlett-Packard 8453 diode array spectrophotometer in transmission mode.

The element was then imaged by subjecting it to a flash lamp exposure. The window of a flash lamp capable of delivering 9 joules/cm$^2$ was fitted with a mirror box that reduced the exit aperture to 11×14 cm. On top of this was placed a mask having an aperture of 1.2×4.2 cm. The element was then placed in contact with the mask and covered with a piece of white paper and a glass plate. The flash was fired at full intensity, the element removed and the visible spectrum measured with the above spectrophotometer.

Dark stability testing of the imaged samples was then performed in a wet oven at 50° C., 50% RH for 5 days, and the stability was evaluated based on the percent loss of the absorption maxima of the imaged and nonimaged samples. The results are also shown in the following Table 1:

TABLE 1

| Dye | λ-max (nm) in $CH_3OH$ | λ-max (nm) as Coated | λ-max (nm) After Flash | Δλ (nm) | D-max/ D-min | Dark Stability (% Changed in D-max) As Coated | Imaged |
|---|---|---|---|---|---|---|---|
| 1 | 659 | 827 | 673 | 154 | 11.1 | −1.0% | −9.8% |
| 2 | 664 | 805 | 686 | 119 | 5.3 | −1.5% | −5.2% |
| 9 | 552 | 620 | 561 | 59 | 5.6 | +1.6% | +7.0% |
| 11 | 542 | 619 | 551 | 68 | 4.5 | — | — |
| 12 | 715 | 885 | 727 | 158 | 6.1 | 0.0% | +1.1% |
| 13 | 660 | 770 | 673 | 97 | 9.4 | 0.0% | +1.6% |
| C-1 | 659 | 730 | 673 | 57 | 1.8 | −3.0% | −2.2% |

The above results show that a significant color change was observed for all the examples upon flash exposure. In the elements containing Dyes 1, 2, 12, 13, a cyan image was generated on a near colorless or light-blue background due to the formation of J-aggregate in the near infrared region (λmax≧770 nm). In the element containing cyanine dye 9, a magenta image was obtained on a blue background. All the examples except the control in Table 1 shows a reasonable D-max/D-min value (>5.0).

The cyanine dye from U.S. Pat. No. 4,767,696 (the control) forms a broad J-aggregate at 730 nm under the experimental conditions of the current invention as compared with the J-aggregate formation at 780 nm in the presence of cationic film forming materials shown in U.S. Pat. No. 4,767,696. However, this dye only showed a moderate image contrast (Dmax/Dmin=1.8) and a high background (due to aggregation closer to the visible region of the spectrum with a λmax at 730 nm. These imaging samples also show good dark stability.

Example 2

Thermal Print Head Exposure

The elements of Example 1 were imaged with a thermal resistive head in a stepwise fashion at a heating speed of 4 ms/line for a 640 line image and heating voltage of 14 v.

The imaging electronics were activated causing the element to be drawn through the printing head/roller nip at 40.3 mm/sec. Coincidentally, the resistive elements in the thermal print head were pulsed for 127.75 μs/pulse at 130.75 μs intervals during a 4.575 ms/dot printing cycle (including a 0.391 ms/dot cool down interval). A stepped image density was generated by incrementally increasing the number of pulses/dot from a minimum of 0 to a maximum of 32 pulses/dot. The voltage supplied to the thermal head was approximately 14.0 v resulting in an instantaneous peak power of 0.369 watts/dot and a maximum total energy of 1.51 mJ/dot; print room humidity: 42–45% RH. The following images were obtained on a light-blue background except for element C where a magenta image was obtained on a blue background:

TABLE 2

| Element | Dye | λ-max (nm) as Coated | λ-max (nm) After Printing | Δλ (nm) | D-max/ D-min |
|---|---|---|---|---|---|
| A | 1 | 827 | 672 | 155 | 10.4 |
| B | 2 | 805 | 686 | 119 | 4.9 |
| C | 9 | 620 | 560 | 60 | 5.2 |
| D | 12 | 885 | 727 | 158 | 5.9 |
| E | 13 | 770 | 673 | 97 | 8.1 |
| Control | C-1 | 730 | 673 | 57 | 1.5 |

The above results show that similar color change was observed for thermal print head exposure as compared to flash lamp exposure with slightly lower D-max/D-min. The elements containing Dyes 1, 2, 12, 13 and C-1 gave a 640 line cyan digital image. The element containing dye 9 gave a magenta digital image. Again, the control dye C- 1 gives the lowest D-max/Dmin value.

Example 3

Laser Exposure

A) Element A of Example 1 was imaged with an IR laser writer (830 nm) with maximum energy of 300 mJ/cm$^2$. For element A, due to the high absorption of the Dye 1 aggregate at 830 nm, no IR dye is necessary for laser imaging.

B) An element similar to B) of Example 1 was employed except that it contained the following IR absorber in an amount of 0.22 wt-% so as to give a final laydown of 0.05 g/m$^2$ of IR Absorber dye:

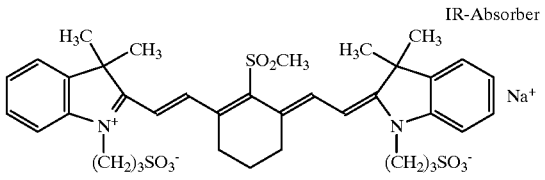

C) An element similar to C) of Example 1 was employed except that it contained the IR absorber of B) in an amount of 0.22 wt-% so as to give a final laydown of 0.05 g/m$^2$ of IR Absorber dye.

Control) A control element similar to the Control of Example 1 was employed except that it contained the IR absorber of B) in an amount of 0.22 wt-% so as to give a final laydown of 0.05 g/m$^2$ of the IR Absorber dye.

The above elements were written using a laser diode print head, where each laser beam has a wavelength range of 830–840 nm and a nominal power output of 600 mW at the film plane. The drum, 53 cm in circumference was rotated at varying speeds and the imaging electronics were activated to provide adequate exposure. The translation stage was incrementally advanced across the recording element by means of a lead screw turned by a microstepping motor, to give a center-to-center line distance of 10.58 $\mu$m (945 lines per centimeter or 2400 lines per inch). The measured total power at the focal plane was 600 mW per channel. At a rotation of 1000 rpm, the exposure was about 300 mJ/cm$^2$. The following results were obtained:

TABLE 3

| Element | Dye | λ-max (nm) as Coated | λ-max (nm) After Printing | Δλ (nm) | D-max/ D-min |
|---|---|---|---|---|---|
| A | 1 | 827 | 673 | 154 | 11.0 |
| B | 2 | 805 | 686 | 119 | 5.4 |
| C | 9 | 620 | 559 | 61 | 6.1 |
| Control | C-1 | 730 | 673 | 57 | 1.8 |

The above results show that the above samples can be imaged with laser writer similar to flash exposure and thermal resistive head printing. A cyan digital image was obtained for dyes 1, 2 and C-1, and a magenta digital image was observed for dye 9. The Dmax/Dmin value for laser imaging is close to that of the flash exposure method.

The invention has been described in detail with particular reference to preferred embodiments thereof, but it will be understood that variations and modifications can be effected within the spirit and scope of the invention.

What is claimed is:

1. A thermal recording element comprising a support having thereon a recording layer comprising a J-aggregate cyanine dye dispersed in a hydrophilic binder, said J-aggregate dye having the formula:

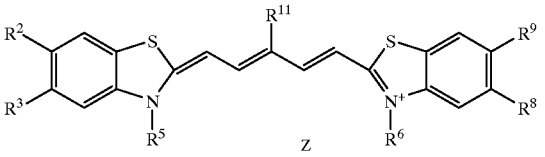

wherein $R^2$, $R^3$, $R^8$ and $R^9$ each independently represents hydrogen, a substituted or unsubstituted alkyl or alkoxy group having from about 1 to about 6 carbon atoms; halogen; a substituted or unsubstituted aryl group having from about 6 to about 10 atoms; or a substituted or unsubstituted heteroaryl group having from about 5 to about 10 atoms;

any two adjacent substituents on the aryl rings may be taken together to form a 6-membered aromatic ring;

$R^5$ and $R^6$ each independently represents a substituted or unsubstituted alkyl group having from about 1 to about 6 carbon atoms or sulfoalkyl;

Z represents an inorganic or organic cation; and $R^{11}$ is an alkyl group having from 2 to about 6 carbon atoms.

2. The element of claim 1 wherein $R^{11}$ is ethyl.

3. A thermal recording element comprising a support having thereon a recording layer comprising a J-aggregate cyanine dye dispersed in a hydrophilic binder, said J-aggregate dye having the formula:

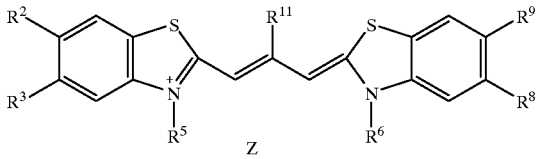

wherein $R^2$, $R^3$, $R^8$ and $R^9$ each independently represents hydrogen, a substituted or unsubstituted alkyl or alkoxy group having from about 1 to about 6 carbon atoms; halogen; a substituted or unsubstituted aryl group having from about 6 to about 10 atoms; or a substituted or unsubstituted heteroaryl group having from about 5 to about 10 atoms;

any two adjacent substituents on the aryl rings may be taken together to form a 6-membered aromatic ring;

$R^5$ and $R^6$ each independently represents a substituted or unsubstituted alkyl group having from about 1 to about 6 carbon atoms or sulfoalkyl;

Z represents an inorganic or organic cation; and $R^{11}$ is an alkyl group having from 2 to about 6 carbon atoms.

4. The element of claim 3 wherein $R^{11}$ is ethyl.

5. A process of forming a single color image comprising imagewise-exposing by means of a flash, thermal print head or laser, in the absence of a separate receiving element, a thermal recording element comprising a support having thereon a recording layer, thereby imagewise-heating said recording layer and causing it to change color to create said single color image, said recording layer comprising a J-aggregate cyanine dye dispersed in a hydrophilic binder, said J-aggregate dye having the formula:

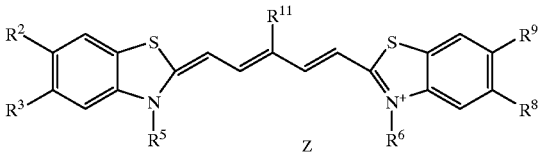

wherein $R^2$, $R_3$, $R_8$ and $R^9$ each independently represents hydrogen, a substituted or unsubstitated alkyl or alkoxy group having from about 1 to about 6 carbon atoms;

halozen; a substituted or unsubstituted aryl group having from about 6 to about 10 atoms; or a substituted or unsubstituted heteroaryl group having from about 5 to about 10 atoms;

any two adjacent substituents on the aryl rings may be taken together to form a 6-membered aromatic ring;

$R^5$ and $R^6$ each independently represents a substituted or unsubstituted alkyl group having from about 1 to about 6 carbon atoms or sulfoalkyl;

Z represents an inorganic or organic cation; and $R^{11}$ is an alkyl group having from 2 to about 6 carbon atoms.

6. The process of claim 5 wherein $R^{11}$ is ethyl.

7. A process of forming a single color image comprising imagewise-exposing by means of a flash, thermal print head or laser, in the absence of a separate receiving element, a thermal recording element comprising a support having thereon a recording layer, thereby imagewise-heating said recording layer and causing it to change color to create said single color image, said recording layer comprising a J-aggregate cyanine dye dispersed in a hydrophilic binder, said J-aggregate dye having the formula:

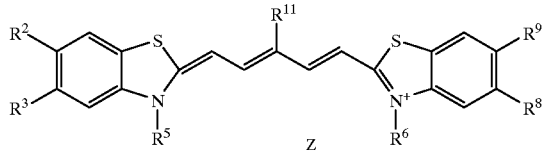

wherein $R^2$, $R^3$, $R^8$ and $R^9$ each independently represents hydrogen, a substituted or unsubstituted alkyl or alkoxy group having from about 1 to about 6 carbon atoms; halogen; a substituted or unsubstituted aryl group having from about 6 to about 10 atoms; or a substituted or unsubstituted heteroaryl group having from about 5 to about 10 atoms;

any two adjacent substituents on the aryl rings may be taken together to form a 6-membered aromatic ring;

$R^5$ and $R^6$ each independently represents a substituted or unsubstituted alkyl group having from about 1 to about 6 carbon atoms or sulfoalkyl;

Z represents an inorganic or organic cation; and $R^{11}$ is an alkyl group having from 2 to about 6 carbon atoms.

8. The process of claim 7 wherein $R^{11}$ is ethyl.

* * * * *